US006578758B1

(12) United States Patent
Grigsby, Jr. et al.

(10) Patent No.: US 6,578,758 B1
(45) Date of Patent: Jun. 17, 2003

(54) AIR BREATHABLE BULK MATERIALS CONTAINER

(75) Inventors: John M. Grigsby, Jr., Woodstock, GA (US); Jeffrey C. Banks, Austell, GA (US)

(73) Assignee: North American Container Corp., Mableton, GA (US)

( * ) Notice: Subject to any disclaimer, the term of this patent is extended or adjusted under 35 U.S.C. 154(b) by 0 days.

(21) Appl. No.: 09/994,176

(22) Filed: Nov. 26, 2001

(51) Int. Cl.[7] ..... B65D 85/50; B26F 1/24

(52) U.S. Cl. ..... 229/120; 47/84; 83/30; 83/51; 220/676; 220/913; 229/122.32; 229/199.1; 493/63; 493/73

(58) Field of Search ..... 229/120, 122.32, 229/122.33, 122.34, 199.1; 220/676, 913; 47/84; 206/423; 426/124, 411, 419; 83/30, 51; 493/63, 73, 372

(56) References Cited

U.S. PATENT DOCUMENTS

| | | | | | |
|---|---|---|---|---|---|
| 1,407,688 | A | | 2/1922 | Banton | |
| 2,533,773 | A | | 12/1950 | De La Foret | |
| 2,841,319 | A | | 7/1958 | White et al. | |
| 3,071,045 | A | | 1/1963 | Budd | |
| 3,486,680 | A | | 12/1969 | Negus, Jr. | |
| 3,492,853 | A | * | 2/1970 | Gross | 83/51 |
| 3,786,708 | A | * | 1/1974 | Mumper | 493/372 |
| 4,487,539 | A | * | 12/1984 | Taylor et al. | 83/51 |
| 4,515,266 | A | | 5/1985 | Myers | |
| 4,561,579 | A | * | 12/1985 | Fleming, III et al. | 83/51 |
| 4,586,627 | A | | 5/1986 | Grigsby | |
| 4,635,815 | A | | 1/1987 | Grigsby | |
| 4,941,572 | A | | 7/1990 | Harris | |
| 5,575,418 | A | | 11/1996 | Wu et al. | |
| 6,079,304 | A | * | 6/2000 | Bisceglia | 83/51 |
| 6,126,067 | A | | 10/2000 | Grigsby, Jr. et al. | 229/120 |
| 6,212,982 | B1 | * | 4/2001 | Augustin et al. | 83/30 |

FOREIGN PATENT DOCUMENTS

JP 3-187837 8/1991

OTHER PUBLICATIONS

Wood–Cleated Corrugated brochure, North American Container Corp. (undated).

* cited by examiner

*Primary Examiner*—Gary E. Elkins
(74) *Attorney, Agent, or Firm*—Baker, Donelson, Bearman & Caldwell

(57) ABSTRACT

A container for leaf product and other bulk pack materials wherein a blank of corrugated paperboard is scored to define side walls of the container, and a field of passageways are defined in at least one side wall of the container by a conical pin punch-pressed from opposing sides of the blank to define a passageway for communication of moisture from the container to the atmosphere for drying and long term storage of the leaf products. A method of defining passageways in the blank of paperboard is disclosed.

20 Claims, 5 Drawing Sheets

AIR BREATHABLE BULK MATERIALS CONTAINER

TECHNICAL FIELD

The present invention relates to containers for holding and storing bulk materials. More particularly, the present invention relates to air-breathable containers that facilitate communication from the container of moisture emitted from bulk materials such as leaf products held in the container for drying and long-term storage.

BACKGROUND OF THE INVENTION

Large-volume containers are often used for holding, storing, and transporting bulk materials, such as powders, leaf and root crop products, metal castings, plastic resins, and many other materials. Generally, the containers provide sturdy walls for protecting the bulk materials while allowing the containers to be handled by equipment such as fork lift trucks and platen trucks. The containers are also often stacked in warehouses.

Some containers also facilitate the drying and curing of the bulk materials. For example, some leaf products are held in containers made with wood-slats that are secured together with enwrapping metal bands. There are gaps between adjacent edges of the wood slats in the wall of the container. As the leaf products emit moisture and dry, the moisture communicates from the container through the gaps to the atmosphere. The escape of the moisture prevents mold from attacking the leaf products. These containers also allow for long-term storage of the leaf products. This enables the products to cure to useful raw material. The containers have sturdy walls which enable the containers to be stacked for storage in warehouses.

Since the total weight of a single loaded container may run as high as fifteen hundred (1500) pounds, the packing and shipping of bulk materials presents several unique problems. One problem is that such bulk materials are typically poured or thrown into the container and shipped loose so that the packed materials "flow" about the interior of the container. Materials of lesser densities may be pressed or compacted during filling of the container. After filling, the memory of the packed material exerts an outward force on the side walls of the pack. The side walls of the container must be sufficiently rigid in the horizontal plane to withstand internal movement or expansion of the materials and thereby must resist against bulging as a result of internal material flow. Another problem is that the side walls of the container must also be sufficiently rigid to permit stacking of one container on top of another. The side walls must provide sufficient compression strength to prevent any deformation or collapse of the container when others are stacked upon it.

U.S. Pat. No. 4,635,815 discloses a corrugated paperboard container having an exterior tubular corrugated paperboard body laminated to an interior tubular corrugated paperboard body, and includes a plurality of support members fixedly secured between the exterior and interior bodies so as to reinforce the container. While this container has been successful in long-term storage of bulk materials, it has not been gainfully used with fresh leaf products. The corrugated paperboard would prevent escape of moisture from the container. The leaf products would become damaged by mold and decay which leads to lost value. The leaf products must first dry by removal of the moisture held in the leaf products before long term storage can be made successfully with paperboard-type containers. However, transfer of such leaf products from the wood slat containers to the corrugated paperboard container after drying is not efficient. The wood slat containers have drawbacks to their continued use for leaf products. These problems include the costs and availability of such containers.

Our U.S. Pat. No. 6,126,067 describes a corrugated paperboard container having at least one side panel with a plurality of openings defined by drilling through the side panel with a non-fluted drill, whereby the openings provide for communicating moisture through the panel and outwardly of the container. While this container satisfactorily facilitates drying of leaf products, some believe there are drawbacks which may limit the use of such containers. Particularly, the open flutes in the corrugated side panel may become occluded such as with dust particles carried by the communicated air, and the effectiveness of the container for drying leaf products may be reduced.

Accordingly, there is a need in the art for an improved air-breathable container that facilitates communication from the container of moisture emitted from the leaf products held in the container for drying and long-term storage. It is to such that the present invention is directed.

BRIEF SUMMARY OF THE INVENTION

The present invention solves the above-described problems in the prior art by providing a container that facilitates communication of moisture from the container for drying and long-term storage of leaf products. The container comprises a blank of a sheet material scored to define two opposing end panels and two opposing side panels. The blank is foldable on the scores and a pair of opposing distal ends are adhered together to define a tubular body openable from a first position which is substantially flat to a second position squared-open for receiving a plurality of leaf products within a cavity defined by the opposing end and side panels. At least one of the panels includes a field of spaced-apart passageways defined by conical pins pushed through the side wall in a first direction and a second opposing direction whereby sheet material from the fiber board in the corrugated paper and sheet is disposed as a lining for the passageways for communicating moisture through the panel. A bottom closes a first open end of the tubular body and a top cap closes a second open end of the tubular body. The leaf products, being held within the tubular body, emit moisture which communicates through the passageways in the panel to atmosphere for drying and long-term storage of the leaf products.

A second embodiment of the present invention includes an outer wall-forming blank of corrugated paperboard scored to provide a series of wall panels foldably joined together and a second wall-forming blank of corrugated paperboard also scored to provide a series of wall panels foldably joined together. The second wall-forming blank is formed for bonding to the inside surface of the first wall-forming blank. A plurality of support members are fixedly retained between the first wall-forming blank and the second wall-forming blank, with at least one support member being provided on each wall of the container. Further, a plurality of corrugated sheets are secured between both the first wall forming blank and the second wall forming blank. At least one of the walls defined by the blanks defines a field of spaced-apart passageways for communicating moisture through the wall. The passageways are defined by conical pins pushed through the side wall in a first direction and a second opposing direction whereby sheet material of the fiberboard layers in the wall is disposed within the passageway as a lining for the passageway for communicating moisture through the panel. The unitary container accordingly facilitates communication of moisture from leaf products to atmosphere while reinforced side walls provide compression strength and prevent against any bulging.

In another aspect, the present invention provides a method of defining passageways in a side wall of a container for drying and long-term storage of leaf products, comprising the steps of:

(a) receiving a blank of a sheet material between aligned opposing first and second plates each defining a plurality of spaced-apart openings, the blank scored to define two opposing end panels and two opposing side panels, foldable on the scores and a pair of opposing distal ends thereof adhered together to define a tubular body openable from a first position which is substantially flat to a second position squared-open for receiving a plurality of leaf products within a cavity defined by the opposing end and side panels;

(b) moving a first array of conical pins from a retracted position to an extended position through the openings in the first plate with the conical pins extending substantially to a mid-point of the thickness of the blank to define a portion of passageways through the blank; and (c) moving a second array of conical pins from a retracted position to an extended position through the openings in the second plate with the conical pins extending substantially to a mid-point of the thickness of the blank to define a second portion of passageways through the blank, whereby leaf products, being held within the tubular body, emit moisture which communicates through the field of passageways in the panel to atmosphere for drying and long-term storage of the leaf products.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
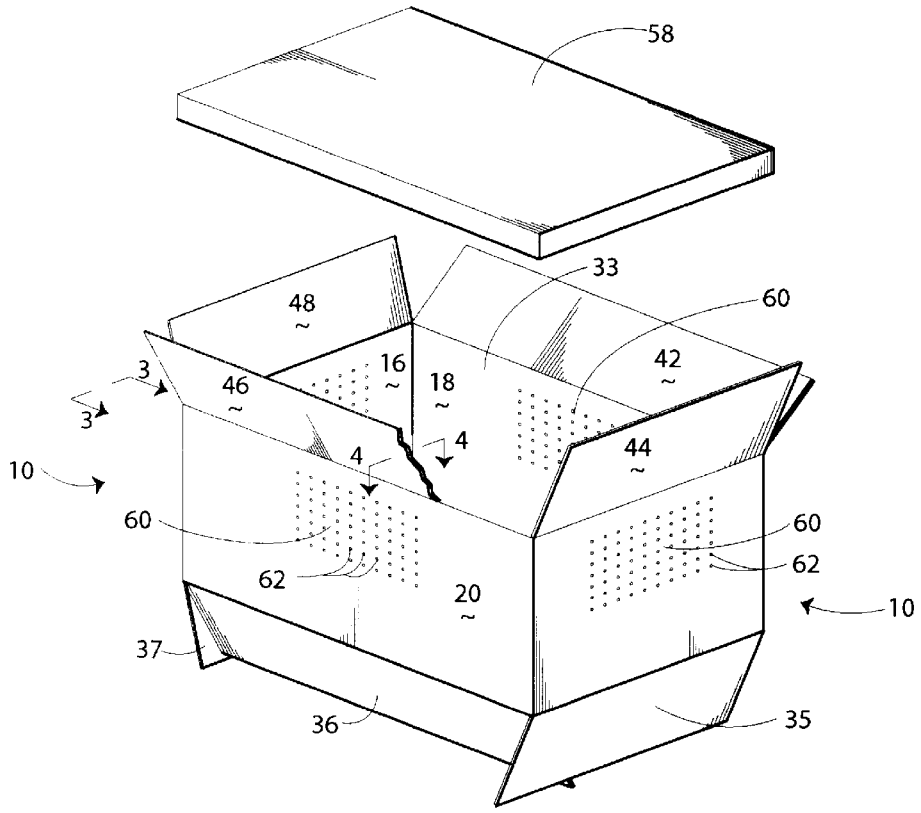
FIG. 1 is a pictorial view of an embodiment of a bulk material container according to the present invention.
Figure 2:
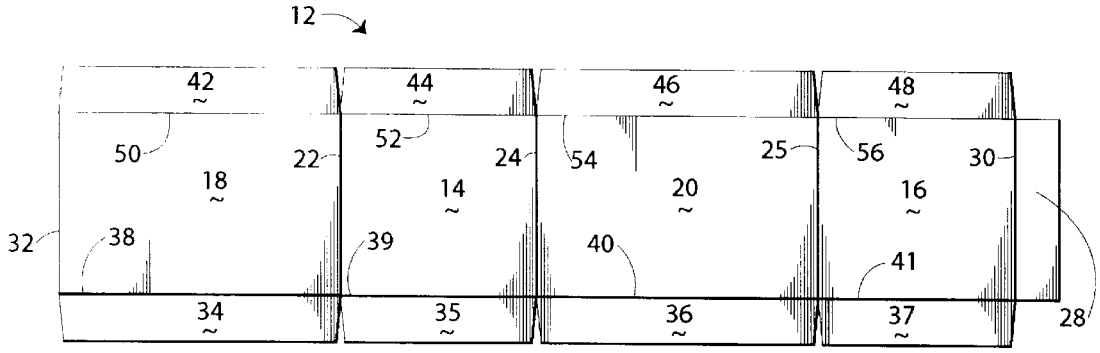
FIG. 2 is a plan view of a paperboard blank for forming the bulk material container illustrated in FIG. 1.

Referring now in more detail to the drawings, in which like numerals indicate like parts throughout the several views, FIG. 1 illustrates a container 10 of the present invention for holding bulk materials for drying and long-term storage. The container 10 is formed from a blank of sheet material 12 illustrated in FIG. 2. The sheet material 12 is preferably corrugated paperboard. The sheet material 12 includes two opposing end panels 14, 16 and two opposing side panels 18, 20 foldably connected along scores 22, 24, and 26. The end panels 14, 16 and the side panels 18, 20 define the sides of the container 10 shown in FIG. 1. A manufacturer's joint flap 28 foldably connects on a score 30 to the end panel 16. The manufacturer's joint flap 28 attaches with adhesive to a side portion 32 of the side panel 18 to form a tubular body for the container 10. The scores 22, 24, 26, and 30 permit the container 10 to substantially flatten to a knock-down position for shipping from a container manufacturer to a company using the container. For use, the container 10 is squared-open as in FIG. 1 to define a cavity 33 for holding bulk materials.

FIG. 1 further shows a series of four bottom flaps 34, 35, 36, and 37 foldably attached to the end and side panels 14, 16, 18, and 20, respectively, along scores 38, 39, 40, and 41. Similarly, a series of four top flaps 42, 44, 46, and 48 foldably attach on an opposing side of the end and side panels 14, 16, 18, and 20, respectively, along scores 50, 52, 54, and 56.

FIG. 1 further shows a cap member 58 positioned immediately above the container 10. The cap member 58 may be formed of any suitable material, such as corrugated paperboard, and is provided for closing off the top of the container 10. Thus, the cap member 58 is dimensioned so as to fit snugly over the top of the container 10. The details of the cap member 12 are outside the scope of the present invention and thus, it is not disclosed further herein.

Those skilled in the art will recognize that FIG. 1 shows no bottom support member such as a pallet or a slip sheet under the bottom of the container 10. Of course, various bottom support members could be provided including, but not limited to, pallets, slip sheets and bottom caps. Such bottom support members are well known in the art, and hence, need not be disclosed further herein. Thus, it is to be understood that the present invention has applications other than through conventional corrugated paperboard containers. For example, the present invention may take the form of a tube-like container consisting of only side walls with no top or bottom flaps, but having top and bottom caps similar to the top cap 58.

The container 10 of the present invention is breathable for communication of air and moisture from the cavity 33 to the atmosphere. At least one of the panels defining the walls of the container 10 is provided with a field 60 of passageways 62. In the illustrated embodiment, each of the opposing end and side panels 14, 16, 18, and 20 are provided with the fields 60 of passageways 62. The fields 60 each preferably define a rectangular 7×10 grid of passageways 62, although other field patterns and numbers of passageways can be used. The passageways 62 permit moisture to pass from the cavity 33 to atmosphere, while reducing passage of contaminants into the cavity.

Figure 3:
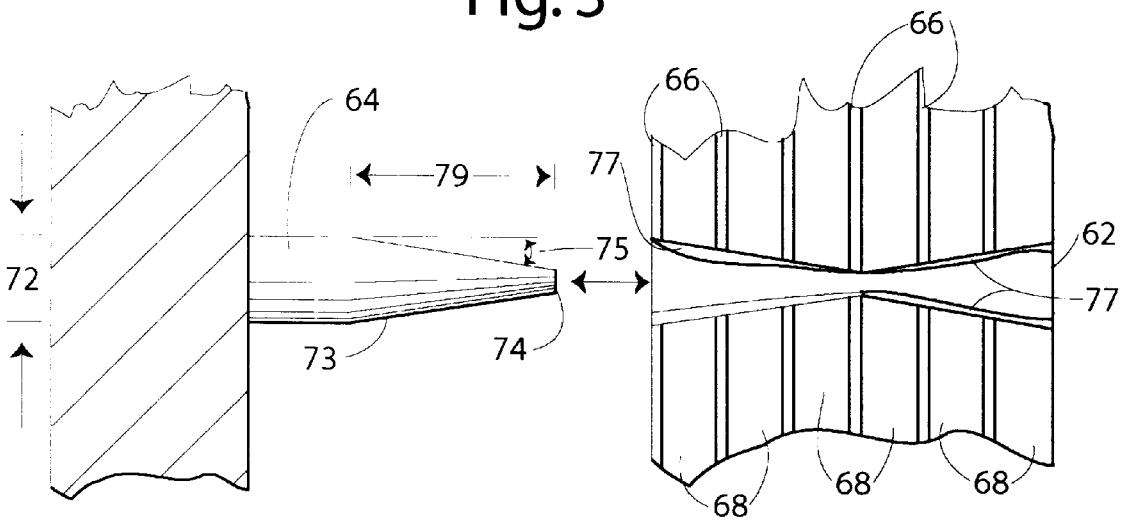
FIG. 3 is a detailed side view of a conical pin for forming a passageway in a side panel of the bulk container illustrated in FIG. 1, for communicating moisture emitted from the materials in the container to atmosphere.

FIG. 3 illustrates a detailed side view of a conical pin 64 and a portion of the side panel taken along line 3—3 in FIG. 1. The conical pin 63 forms the passageways 62 in the field 60 in the bulk container illustrated in FIG. 1, which passageways 62 communicate moisture emitted from leaf materials in the container to the atmosphere. A preferred embodiment of the breathable container 10 uses three layers 65 of double wall corrugated paperboard. Corrugated paperboard conventionally has opposing sheets of fiberboard 66 that sandwich the flutes 68, best illustrated in FIG. 4.

Figure 4:
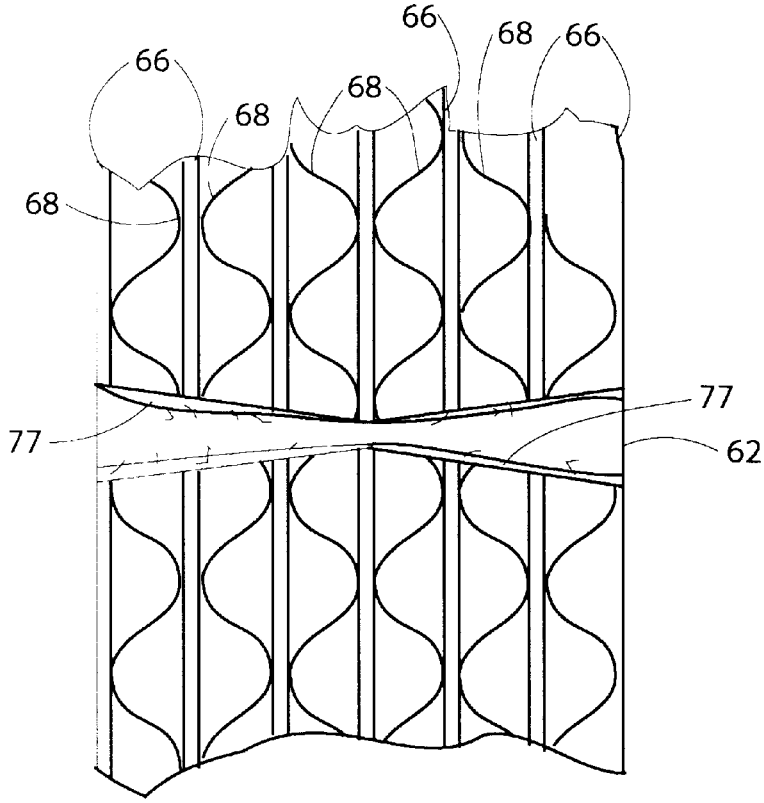
FIG. 4 is a cross-sectional view illustrating the passageway formed by the conical pin illustrated in FIG. 3, according to the present invention.

The conical pin 64 defines the passageways 62 in the panel. The conical pin 64 in the preferred embodiment has a 0.25 inch diameter 72 with a conical tip 73 tapering at an angle 75 of about 8–10 degrees relative to a plane perpendicular to a longitudinal axis of the pin for a length 79 of about one inch from the distal end 74. The conical pin 64 presses from a first direction (illustrated) and from an opposing second direction to define the substantially hourglass-shaped passageway 62 as shown in side view taken along line 3—3 of FIG. 1 and in FIG. 4 taken along line 4—4 of FIG. 1. Portions generally 77 of the fiberboard 66 tear upon entry of the pin 64 and fold inwardly against the flutes 68. The fiberboard portions 77 are thereby disposed as a liner of the passageway and close the flutes, as illustrated in FIG. 4 in cross-sectional view taken along line 4—4. The diameter of the passageways 62 ranges from between about 0.118 inch at the narrow mid-point to about 0.025 inch at the entrances in the side wall surfaces. The passageways 62 are preferably on one-inch centers. These passageways are large enough to allow sufficient air flow and release of moisture from the container, yet small enough to prevent dust and other particles from exiting the container while keeping insect and debris from entering.

Figure 5:
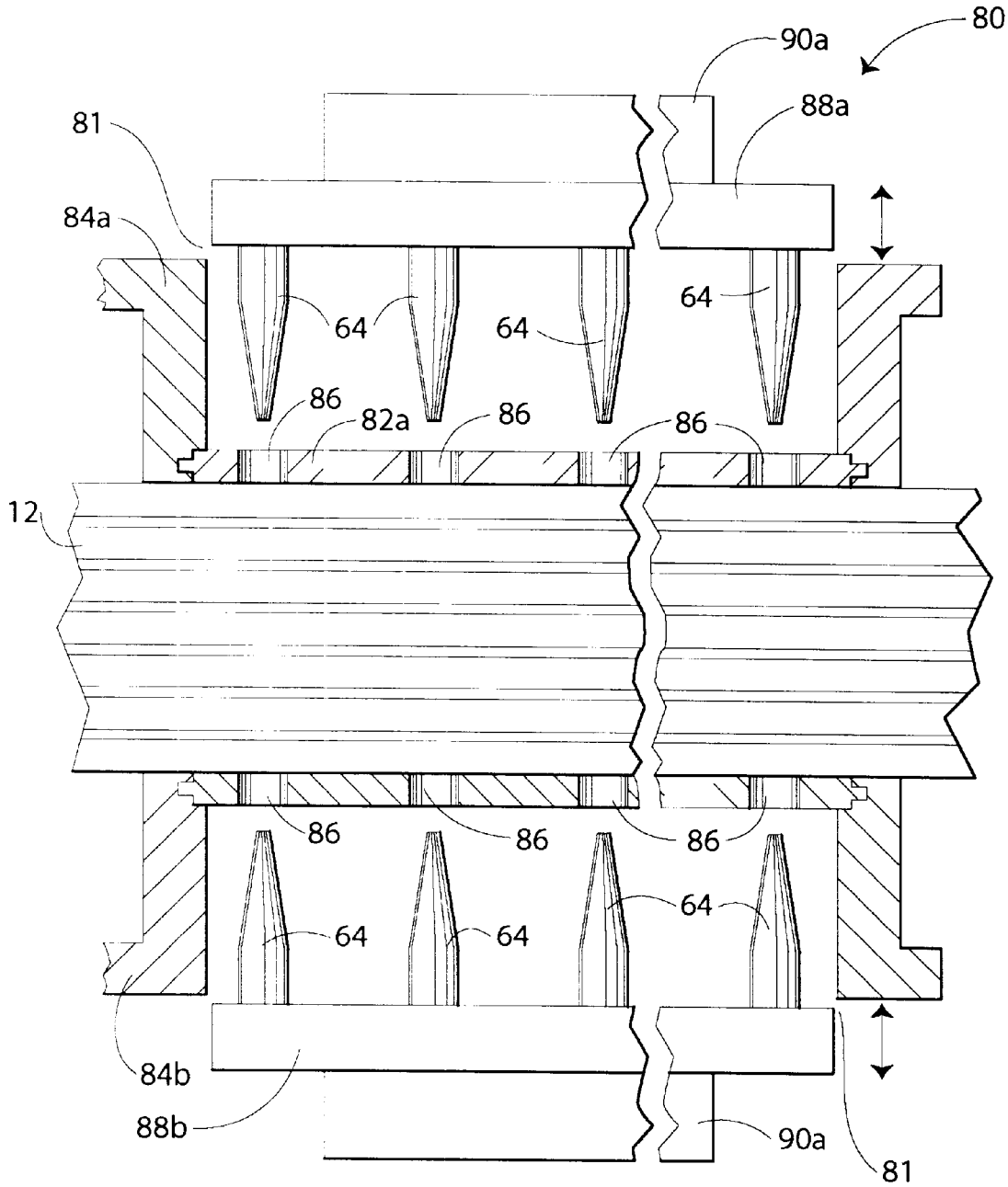
FIG. 5 is a side view of an apparatus for defining a field of the passageways in a panel of the bulk material container illustrated in FIG. 1.

FIG. 5 is a side view of a module 80 having an array 81 of conical pins 64 for forming the fields 60 of passageways 62 in the panels of the container 10. The module 80 has a pair of parallel plates 82*a*, 82*b*, each of which is secured to a respective movable frames 84*a*, 84*b*. The opposing frames 84 each connect to drives whereby the frame 84 moves from a first position retracted away from the opposing frame 84 and a second position towards the opposing frame 84 in order to sandwich the corrugated paperboard blank 12 between the plates 82 as illustrated. The plates 82 define openings 86 aligned with the conical pins 64 in the array 81 for passage of the pins through the plates 82. The arrays 81 of conical pins 64 connect to supports 88*a*, 88*b*. The supports 88 connects to respective arms 90 actuated by hydraulic cylinders or other operating devices, which move the respective support 88 from a first position retracted from the plate 82 and a second position with the pins 63 passed through the openings 86 in the plate 82 towards the opposing plate 82.

The module 80 operates to form at least a portion of the passageways 62 in the panels 14, 16, 18, and 20. The frames 84 are moved to the first positions spaced apart in order for the blank 12 of corrugated paperboard to move into the module 80, such as upon rollers. Upon positioning of the blank 12, the frames 84 are moved towards each other to the second opposing position whereby the blank 12 is firmly held between the opposing frames 84 and the opposing plates 82.

The support 88*a* for the array 81 of pins 64 is then moved from the retracted position to the extended position. Preferably, the arms 90 connect to hydraulic cylinders or other drive mechanisms in order to move the respective support 88 between the retracted and extended positions. The support 88*a* moves within the frame 84*a* in a first direction towards the opposing support 88*b* to pierce the corrugated paperboard layers in the blank 12 defining the side wall of the container 10. The tip end 74 of the conical pin 64 pierces the fiberboard sheets 66 and the flutes 68 comprising the corrugated paperboard layers 65. The fiberboard tears and folds inwardly forming a liner for the passageway 62 being defined by the conical pin 64. The conical pins 64 are moved until the distal end of the pin slightly exceeds the half-way point of the thickness of the corrugated paperboard in the blank 12. The support 88*a* is then moved from the extended position to the retracted position.

Subsequently, the second opposing support 88*b* is moved from its retracted position to the extended position, whereby the pins 64 in the support 88*b* are passed through the openings 86 in the plate 82*b*. The support 88*b* is moved until the distal end of the conical pins 64 is disposed slightly past the half-way point of the thickness of the corrugated paperboard in the blank 12. The support 88*b* is then moved from the extended position to the retracted position.

Additional portions of the field 60 may then be defined. This is accomplished by repositioning the supports 88 relative to the blank 12. The support 88*a* is then moved from the retracted position to the extended position, as discussed above, whereby another portion of the field of passageways 62 are pierced into the side wall of the container 10. The support 88*b*, repositioned relative to the blank 12, is moved as discussed above to complete the passageways 62. Additional passageways 62 are formed, until the sufficient number of passageways are formed in the side wall of the container 10. As may be appreciated, other modules 80 may be ganged together for piercing an increased number of the passageways 62 simultaneously, or the number of conical pins 64 per module 80 can be increased. In an alternate embodiment (not illustrated), the supports 88 connect to compression springs for forcingly pressing the array 81 of conical pins into the blank 12 upon sudden release of holder securing the support under load of the springs. The opposing frame 84 is held rigidly to bear against the pushing pressure of the support moving under pressure such as by the springs. A hydraulic piston is actuated to reset the support 88 under the compressive loading of the springs for a subsequent cycle in forming the passageways 62.

Figure 6:
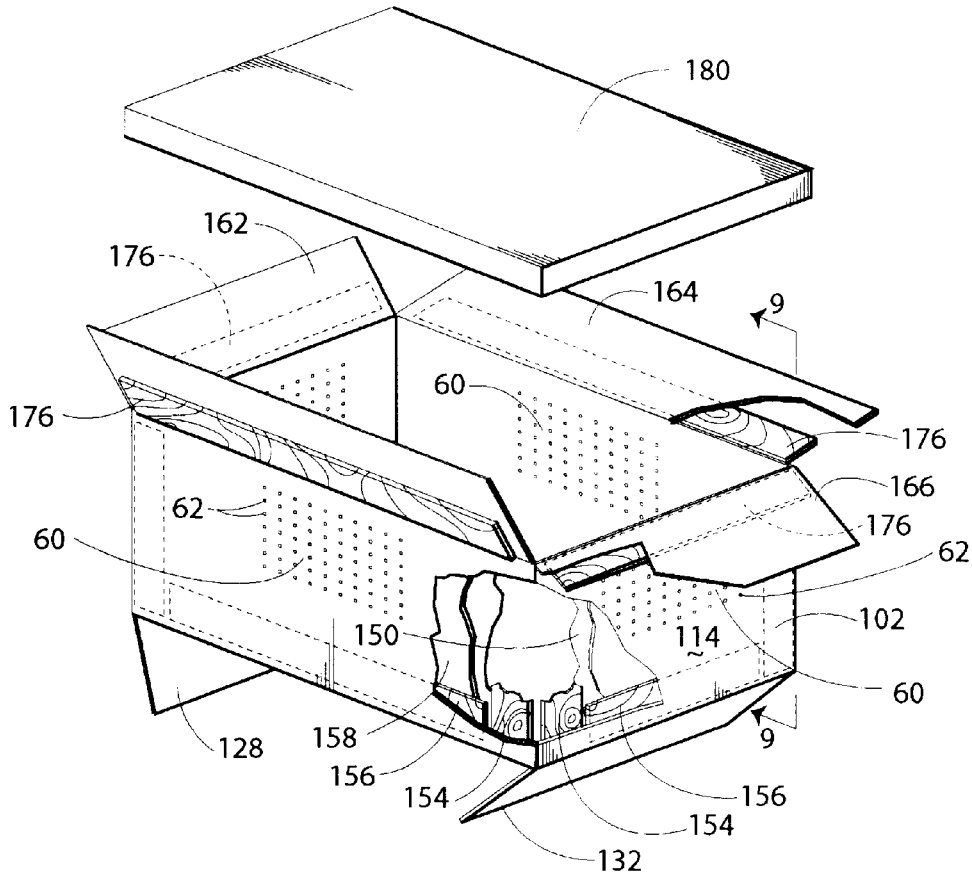
FIG. 6 is a perspective view of an alternate embodiment of a bulk material container according to the present invention, with a portion cut away to illustrate support members.
Figure 7:
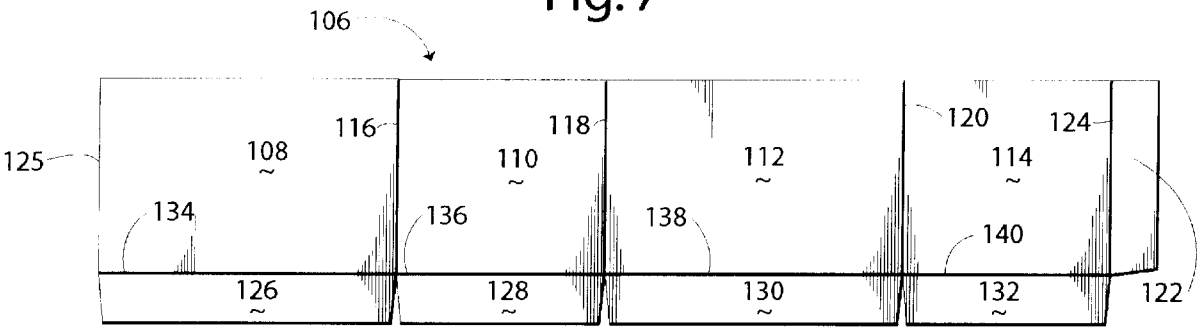
FIG. 7 is a plan view of a paperboard blank for forming an outer shell of the container shown in FIG. 6.

FIG. 6 illustrates an alternate embodiment of the container according to the present invention, which container 100 is formed with an outer shell 102 and an inner liner 104 and includes support members as discussed below. FIG. 7 illustrates a plan view of a blank 106 of a sheet material suitable for forming the outer shell 102. The preferred sheet material is corrugated paperboard. The outer shell blank 106 includes four main panels 108, 110, 112, 114 foldably connected along three score lines 116, 118, and 120. The four main panels 108, 110, 112, 114 form the four outer side walls of the container 100 as shown in FIG. 6. A manufacturer's joint flap 122 is foldably connected to the main panel 114 along a score line 124. The outer shell joint flap 122 attaches to a side portion 125 of the panel 108 to form a collapsible tubular body for the container 100, as described below. Those skilled in the art will appreciate that the outer shell 102 may be modified so that manufacturer's joint flap 122 is positioned within the container 100 instead of lapped over the outside. Such an arrangement is also well-known in the art. A series of four bottom flaps 126, 128, 130 and 132 are foldably connected to the main panels 108, 110, 112, and 114, respectively, along respective score lines 134, 136, 138, and 140.

Figure 8:
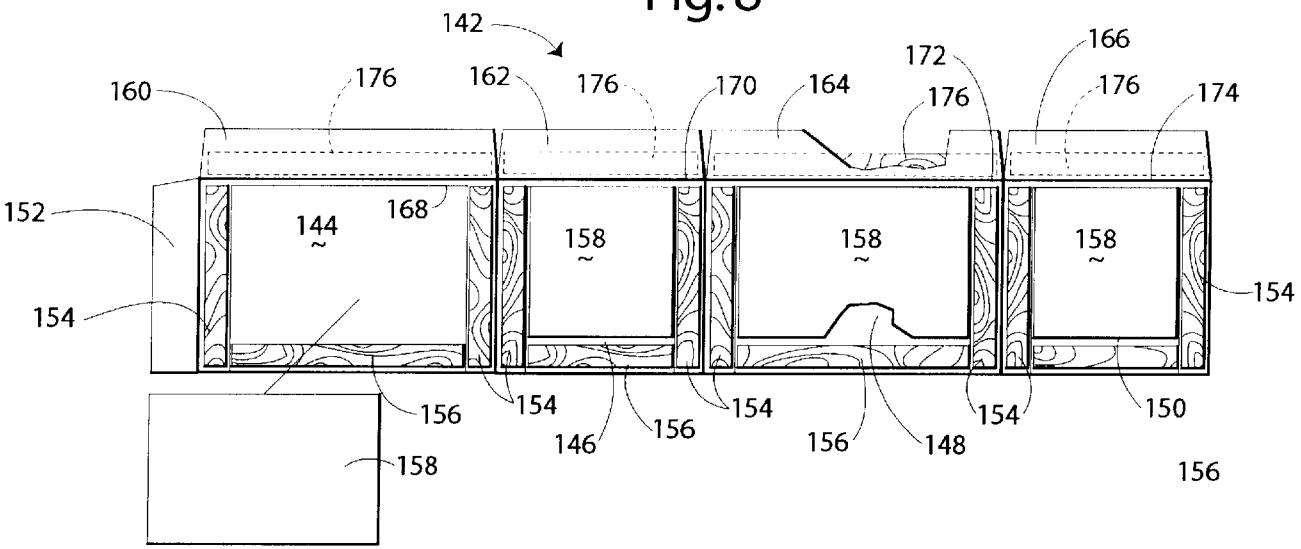
FIG. 8 is a plan view of a paperboard blank for forming the depth liner or inner wall portion of the container shown in FIG. 6, showing the reinforcing members and spacer pads bonded to the depth liner.

FIG. 8 shows a blank 142 of sheet-like material suitable for forming the inner liner 104. While other materials may be used, the preferred material is corrugated paperboard. The inner liner blank 142 includes four main panels 144, 146, 148, and 150, defined by scores in the blank. The main panels 144, 146, 148, and 150 form the four innermost side walls of the container 100 when the inner liner 104 is bonded to the outer shell 102 as described below. The inner liner blank 142 provides a joint flap 152 foldably connected to the main panel 144 along a score line 154. The joint flap 152 attaches with adhesive to side portion of the panel 150.

A plurality of reinforcing or support members 154 are bonded to a first side surface of the inner liner 104. The first side surface of the inner liner 104 (shown in FIG. 8) is that side of the inner liner that is to be engaged to the outer shell 102. The support members 154 may be formed of any suitably rigid material. A particularly preferred material is a wood veneer, typically ranging in thickness from ⅛ inch to ½ inch and in width from 2 and ¾ inches to 3 and ¾ inches. The length of the support members 154 depends upon the height of the container 100. Preferably, the length of the support members 154 is substantially equal to the height of the depth liner 104, which is, in turn, substantially equal to the interior or inside height of the container 100.

One support member 154 is preferably secured to the left and right end portion of each main panel 144, 146, 148, and 150 of the inner blank 142. This bonding may be done using any suitable adhesive. The support members 154 are aligned and secured vertically so to provide the maximum supporting effect when the container 100 is squared-open and erected for use. This positioning results in the support members 154 being located near the corners of the container 100 upon erection of the container. The support members 154 are preferably bonded as close to the corners as possible, but not so close as to prevent the container from being folded down into a substantially flat position. Additionally, in order to further increase container rigidity and compression strength, a support member 154 may be bonded near the center or otherwise intermediate of the outer ends of the main panels 144, 146, 148, and 150 (not illustrated).

As illustrated in FIG. 8, the blank 142 further includes four elongate members 156 with one of such members attached to respective side portions of the main panels 144, 146, 148, and 150. The members 156 are disposed in coaxial alignment and parallel to a longitudinal axis of the blank 142. The members 156 may be formed of any suitably rigid material. A particularly preferred material is wood. The thickness is preferably equal to that of the support members 154, typically ranging in thickness from ⅛ inch to ½ inch and in width from 2 and ¾ inches to 3 and ¾ inches. The members 156 attach to the blank 142 with adhesive or other suitable bonding material.

The inner liner 104 further includes four filler pads 158 with one attached to each of the main panels 144, 146, 148, and 150. The filler pads 158 are formed of any suitably rigid sheet material. A particularly preferred material is corrugated paperboard. The thickness is preferably equal to that of the members 154 and 158. For example, the filler pads 158 are preferably doublewall corrugated paperboard. The filler pads 158 attach to the blank 142 with adhesive or other suitable bonding material. The filler pads 158 fill the volume between the support members 156 and 158, to provide a substantially level face for the inner liner 104 which adheres to the outer shell 102, as discussed below.

An alternate embodiment (not illustrated) does not use the supports 158. The filler pads 158 in this embodiment extend the full height of the inner liner 104. Furthermore, the blanks 106 and 142 may be conventionally formed of paperboard having substantially vertical corrugations. However, the filler pads 158 are preferably made of paperboard having substantially horizontal corrugations. Of course, the blanks 106 and 142 may be formed of paperboard with horizontal corrugations and the filler pads 158 formed of paperboard with vertical corrugations.

The blank 142 further includes a series of four top flaps 160, 162, 164, and 166 foldably joined to the main panels 144, 146, 148, and 150, respectively, along respective score lines 168, 170, 172, and 174. An elongate member 176 attaches to each of the top flaps 160, 162, 164, and 166 on the opposing second side of the blank 142, as shown in partial cut-away view in FIG. 6. Similar to the members 156, the members 176 are disposed in coaxial alignment and parallel to the longitudinal axis of the blank 142. The members 176 may be formed of any suitably rigid material. A particularly preferred material is wood. The thickness is preferably equal to that of the support members 154, typically ranging in thickness from ⅛ inch to ½ inch and in width from 2 and ¾ inches to 3 and ¾ inches. The members 176 attach to the blank 142 with adhesive or other suitable bonding material.

Figure 9:
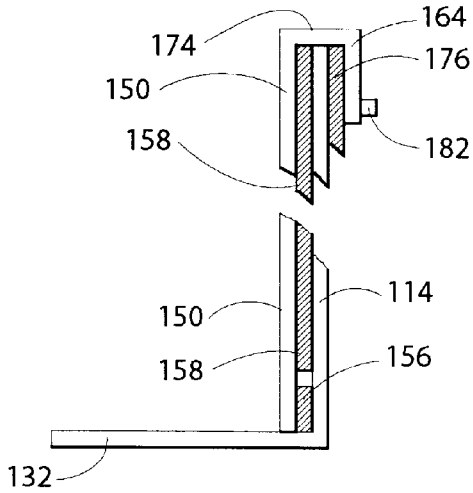
FIG. 9 is a side view illustrating the structure of the container illustrated in FIG. 6.

FIG. 9 shows the corner of the container 100 taken along the lines 9—9 of FIG. 6, and, thereby, shows construction of the same. As discussed below, the inner liner 104 made with the blank 142 shown in FIG. 8 is laminated to the outer shell 102. The side walls of the container 100 accordingly comprise a multiple layer laminate. In particular, the panel 114 of the outer shell 102 and the panel 150 of the inner liner 104 sandwich the support member 154, the member 156, and the filler pad 158. The top flap 166 folds on the score 174 to overlap the upper edge of the panel 114 and thereby dispose the member 176 against the outside surface of the panel 114. The passageways 62 in the field 60 in the side wall are not illustrated in FIG. 9.

The container 100 is manufactured in accordance with the following method. The outer shell blank 102 and the inner liner blank 142 are manufactured as discussed above with respect to FIGS. 7 and 8. The outer shell blank 102, the inner liner blank 142, and the filler pads 158 are preferably formed of double wall corrugated paperboard. As shown in the drawings, the double wall paperboard is particularly well suited for practice of the embodiment of the present invention. The support members 154 are then bonded to the depth liner of the paperboard blank 142. More particularly, the first side (or inside) of each main panel 144, 146, 148, and 150 of the depth liner blank 142 is provided with a wood support member 154 at its respective left and right edge portion. As described above, the support members 154 are preferably maintained a distance away from a corner portion of the container so as to provide for the containers being knocked down prior to shipment. The members 156 are attached to side portion with adhesive or bonding material. Further, the filler pads 158 are attached to the first side of the blank 142. The members 176 are then attached to the second side of the blank 142 to the opposing face of the top flaps 160, 162, 164, and 166.

Those skilled in the art will appreciate that the dimensions of the support members 154 (as well as the density of the paperboard) may be varied to provide a desired container strength. Those skilled in the art will further appreciate that additional support members 154 may be added intermediate those shown at the left and right edge portions of the main panels 144, 146, 148, and 150 if the particular application of the present invention requires such.

Once the support members 154 are glued or otherwise bonded to the inner liner 104, the blank 142 may be bonded to the outer shell 102 in the conventional manner. A preferred method is to extrude or roll an adhesive material either onto the outer shell 102 or the inner liner 104. The blanks 106 and 142 are then aligned together and passed through a compression device, thereby bonding same.

In accordance with the present invention, the fields 60 of passageways 62 are then formed in the panels defining the side walls of the container 100. The fields 60 are formed with the press module 80, as discussed above with respect to FIG. 5. The supports 88 are moved in sequence in opposing directions whereby the pins 64 pierce the blanks to define the passageways 62.

After the fields 60 are formed, the joint tabs 152 and 122 are then adhered to respective surfaces of the panel 158 and 108, to form a tubular, collapsible container 100 illustrated in FIG. 6.

Prior to use, the knocked-down container 100 is squared-open to define the cavity for receiving bulk materials. The bottom flaps 126, 128, 130, and 132 are folded towards the respective opposing flap on the respective scores 134, 136, 138, and 140 to close the open lower end of the container 100. The top flaps 160, 162, 164, and 166 are folded outwardly to bring the respective member 176 into contact with the respective outside surfaces of the panels 108, 110, 112, and 114 of the outer shell 102. As illustrated in FIG. 9, a band 182 wraps around the container 100 on the folded-over top flaps 160, 162, 164, and 166 to secure the top flaps in position.

An alternate embodiment (not illustrated) does not provide the top flaps 160, 162, 164, and 166 in the blank 142 shown in FIG. 8. Rather, the members 176 attach in coaxial alignment to the panels 144, 146, 148, and 150, on a side opposing the members 156. The filler panels 158 are necessarily reduced in size to fit between the members 156 and 176 and the support members 154 on the respective sides of the panels 144, 146, 148, and 150.

FIG. 6 further shows a cap member 180 positioned immediately above the container 100. The cap member 180 may be formed of any suitable material, such as corrugated paperboard, and is provided for closing off the top of the container 100. Thus, the cap member 180 is dimensioned so as to fit snugly over the top of the container 100. The details of the cap member 180 are outside the scope of the present invention and thus, it is not disclosed further herein. Yet another embodiment (not illustrated) likewise attaches the member 176 to the panels 144, 146, 148, and 150, as discussed above. However, this embodiment includes top flaps on the blank 106 defining the outer shell 102. These top flaps fold on scores towards a respective opposing top flap to close the open top of the container.

Thus, the present invention provides an improved breathable bulk material container particularly suited for holding leaf products for drying and long-term storage. Moisture from the drying leaf products communicates through the passageways 62 in the fields 60 of the side walls of the container 100. The support members 154 provide the container with an increased side wall rigidity for both stacking strength and bulge resistance. The members 156 and 176 provide additional side wall strength for handling of the container 100. The placement of the support members 154 between the outer shell 102 and the inner liner 104 insures that the bulk materials stored within the container 100 is not disturbed or damaged by such support member during filling, handling and storage of the containers. The present invention furthermore provides a one-piece, integral unit that can be knocked down flat for shipment to an end user and easily and quickly set up by an end user.

This specification has described the preferred embodiments of the present invention, including the steps necessary for fabricating the preferred embodiments disclosed. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A container for drying and long-term storage of leaf products, comprising:

a blank of a sheet material scored to define two opposing end panels and two opposing side panels, foldable on the scores and a pair of opposing distal ends thereof adhered together to define a tubular body openable from a first position which is substantially flat to a second position squared-open for receiving a plurality of leaf products within a cavity defined by the opposing end and side panels;

at least one of the panels defining a field of spaced-apart passageways for communicating moisture through the panel, each of the passageways defined by opposing conical pins pressing in a first direction and subsequent second direction substantially to a mid-point of the thickness of the panel;

a bottom that closes a first open end of the tubular body and a top cap that closes a second open end of the tubular body, whereby the leaf products, being held within the tubular body, emit moisture which communicates through the field of passageways in the panel to atmosphere for drying and long-term storage of the leaf products.

2. The container as recited in claim 1, wherein the sheet material comprises corrugated paperboard.

3. The container as recited in claim 1, wherein the bottom comprises a plurality of bottom flaps, each foldably attached on a score to a respective one of the opposing end and side panels on a first edge of the blank.

4. The container as recited in claim 1, wherein the top cap comprises a plurality of top flaps, each foldably attached on a score to a respective one of the opposing end and side panels on a second edge of the blank.

5. The container as recited in claim 1, wherein the field of passageways is defined in the panel by an array of spaced-apart conical pins.

6. The container as recited in claim 1, wherein each passageway defines an hour-glass shape.

7. The container as recited in claim 1, wherein the conical pins have a base diameter of about 0.25 inches and have a distal end of about 1 inch tapering at about 8°–10° relative to a side plane parallel to a longitudinal axis of the pin.

8. The container as recited in claim 1, wherein the conical pins have a base diameter of about 0.25 inches and have a distal end of about 1 inch tapering at about 8°–10° relative to a side plane parallel to a longitudinal axis of the pin.

9. A container for drying and long-term storage of leaf products made by the process comprising the steps of:

(a) providing a blank of a sheet material scored to define two opposing end panels and two opposing side panels;

(b) pressing with opposing conical pins a field of spaced-apart passageways in a portion of at least one of the opposing panels for communicating moisture through the panel;

(c) folding the blank on the scores;

(d) adhering a pair of opposing distal ends of the blank adhered together to define a tubular body openable from a first position which is substantially flat to a second position squared-open for receiving a plurality of leaf products within a cavity defined by the opposing end and side panels;

(e) providing a bottom and a top cap that close opposing open ends of the tubular body, whereby leaf products, being held within the tubular body, emit moisture which communicates through the field of passageways in the panel to atmosphere for drying and long-term storage of the leaf products.

10. The container made by the process recited in claim 9, wherein the sheet material provided in step (a) comprises corrugated paperboard.

11. The container made by the process recited in claim 9, wherein the bottom provided in step (e) comprises a plurality of bottom flaps, each foldably attached on a score to a respective one of the opposing end and side panels on a first edge of the blank.

12. The container made by the process recited in claim 9, wherein the top provided in step (e) comprises a plurality of top flaps, each foldably attached on a score to a respective one of the opposing end and side panels on a second edge of the blank.

13. A reinforced bulk material container, comprising:

a first wall-forming blank of paperboard scored to provide a series of main panels foldably joined together at a plurality of corners, said first wall-forming blank defining an inside surface and an outside surface;

a second wall-forming blank of paperboard scored to provide a series of main panels foldably joined together at a plurality of corners, said second wall-forming blank defining a front side surface and a back side surface;

a pair of independent support members glued to the backside of said second wall-forming blank at the location of each said corner, said pair of support members each extending substantially the height of said second wall-forming blank and arranged so as to straddle and be spaced apart from said score;

said backside surface of said second wall-forming blank being laminated to said inside surface of said first wall-forming blank so as to provide a unitary container having a series of reinforced side walls foldably joined together;

at least one of the side walls defining a field of spaced-apart passageways for communicating moisture through the panel, the passageways defined by passing opposing conical pins from a first direction and a second direction into the side wall substantially past a mid-point of the thickness of the side wall;

whereby moisture from products placed in the interior of said container communicates through said passageways.

14. The reinforced bulk material container as recited in claim 13, further comprising a filler pad bonded to each main panel of said second wall-forming blank, said filler being formed of corrugated paperboard and dimensioned so as to extend substantially the width of said main panel between said support members secured thereto and substantially the height of said second wall forming blank.

15. The reinforced bulk material container as recited in claim 13, wherein said passageway defines an hourglass shape.

16. The reinforced bulk material container as recited in claim 13, further comprising at least two elongate members attached to the backsides of respective opposing main panels of the second wall-forming blank.

17. The reinforced bulk material container as recited in claim 13, further comprising a plurality of top flaps foldably joined to the upper edge portion of the wall panels of the second wall-forming blank for being foldably overlapped over a upper edge of the first wall-forming blank.

18. The reinforced bulk material container as recited in claim 17, further comprising a support member attached to a bottom surface of at least one of the top flaps.

19. The reinforced bulk material container as recited in claim 13, further comprising a bottom and a top that close opposing open ends of the container.

20. A method of defining passageways in a side wall of a container for drying and long-term storage of leaf products, comprising the steps of:

(a) receiving a blank of a sheet material between aligned opposing first and second plates each defining a plurality of spaced-apart openings, the blank scored to define two opposing end panels and two opposing side panels, foldable on the scores and a pair of opposing distal ends thereof adhered together to define a tubular body openable from a first position which is substantially flat to a second position squared-open for receiving a plurality of leaf products within a cavity defined by the opposing end and side panels;

(by moving a first array of conical pins from a retracted position to an extended position through the openings in the first plate with the conical pins extending substantially to a mid-point of the thickness of the blank to define a portion of passageways through the blank; and (c) moving a second array of conical pins from a retracted position to an extended position through the openings in the second plate with the conical pins extending substantially to a mid-point of the thickness of the blank to define a second portion of passageways through the blank, whereby leaf products, being held within the tubular body, emit moisture which communicates through the field of passageways in the panel to atmosphere for drying and long-term storage of the leaf products.

* * * * *